United States Patent [19]

Miller et al.

[11] Patent Number: 4,548,040

[45] Date of Patent: Oct. 22, 1985

[54] METHOD AND APPARATUS FOR DETERMINING WHEN TO INITIATE CLEANING OF TURBOCHARGER TURBINE BLADES

[75] Inventors: Robert A. Miller, Jeannette; Edward J. Condrac, North Huntingdon, both of Pa.

[73] Assignee: Elliott Turbomachinery Company, Inc., Jeannette, Pa.

[21] Appl. No.: 609,902

[22] Filed: May 11, 1984

[51] Int. Cl.[4] ..... F02B 37/00

[52] U.S. Cl. ..... 60/619; 415/117

[58] Field of Search ..... 60/39.33, 39.53, 39.54, 60/619; 134/56 R, 57 R, 58 R, 113; 415/116, 117

[56] References Cited

U.S. PATENT DOCUMENTS 2,689,456 9/1954 White ..... 60/39.54 X
3,623,668 11/1971 Freid et al. ..... 60/39.53 X
3,961,482 6/1976 Jamaux ..... 60/619

FOREIGN PATENT DOCUMENTS 91722 7/1980 Japan ..... 60/619
2032002 4/1980 United Kingdom ..... 60/619

*Primary Examiner*—Michael Koczo
*Attorney, Agent, or Firm*—Robert P. Hayter

[57] ABSTRACT

A method and apparatus for determining when to initiate the cleaning of the turbine blades of a turbocharger is disclosed. The performance of the compressor portion of the turbocharger is monitored and upon a degradation in performance being detected it is indicated that fouling of the turbine blades has occurred. In response to this indication a water injection system is energized for supplying atomized water under high pressure to the exhaust gas powering the turbocharger to effectively clean the turbine blades. Means are provided for decreasing the speed of the turbocharger during the cleaning cycle to allow for an effective cleaning operation.

11 Claims, 3 Drawing Figures

METHOD AND APPARATUS FOR DETERMINING WHEN TO INITIATE CLEANING OF TURBOCHARGER TURBINE BLADES

BACKGROUND OF THE INVENTION

This invention relates to a method and apparatus for controlling the cleaning of turbine blades of a turbocharger used with an engine. Specifically the invention concerns sensing an operating parameter of the turbocharger and in response to a degradation in performance as determined by sensing that parameter initiating a cleaning operation to remove accumulated deposits.

Turbochargers are used in conjunction with an engine for numerous reasons. A turbocharger driven by engine exhaust gases uses energy from the exhaust gas that would otherwise be wasted. The turbocharger acts to increase the engine power output by providing higher charge-air density such that more fuel can be burned in each engine cycle, scavenges airflow to clear the cylinders of combustion products and acts to further cool engine parts allowing for power increases. The utilization of a turbocharger with an engine results in increased horsepower output, higher brake mean effective pressure because the higher air density improves engine performance at low loads and permits the engine to operate not only at an optimum efficiency point but also at reduced speeds and loads. The use of a turbocharger may further act to restore sea level ratings on engines operating at high altitudes by compensating for reduced atmospheric pressures, and may make possible maximum speed acceleration to synchronous speed for fast reliable starts as well as reducing fuel and oil consumption.

The exhaust gas from the engine is used as the driving fluid for powering the turbine portion of the turbocharger. The turbine portion is connected by a shaft to the compressor portion of the turbocharger which acts to compress intake air to be delivered to the engine. The exhaust gas powering the turbocharger contains contaminants and particulates caused by incomplete combustion and fuel contaminants. The amount of contaminants released from the engine in the exhaust is a function of the fuel used. Should a "dirty" fuel such as a heavy diesel fuel be utilized, then significant particulates may be discharged with the exhaust.

The utilization of heavy diesel fuels causes buildup of contaminants on the turbine blades causing loss of blade flow path area and adversely affecting performance of the turbocharger. It is necessary to strategically place and suitably size water wash nozzles to periodically clean the blades to restore the blades to a clean condition and thereby to restore full performance to the turbocharger all while the turbocharger remains in service. It is additionally advantageous to provide a control system for automatically or semi-automatically performing this function.

SUMMARY OF THE INVENTION

It is an object of the present invention to provide apparatus for effectively cleaning deposits from turbine blades of a turbocharger.

It is another object of the present invention to provide a method of determining when to initiate cleaning operation of the blades in a turbocharger.

It is a still further object of the present invention to sense an operating parameter of the compressor portion of a turbocharger and initiate cleaning of the turbine blades in response to a degradation in performance of the compressor portion of the turbocharger.

It is a yet further object of the present invention to provide a method and apparatus for effectively determining a need for cleaning and for initiating the cleaning of accumulated deposits from turbine blades in a turbocharger.

It is still another object of the present invention to provide a reliable, cost effective and easily maintained integral water wash control for cleaning the blades in a turbocharger.

Other objects will be apparent from the description to follow and the appended claims.

The above objects are achieved according to a preferred embodiment of the invention by providing apparatus for controlling the cleaning of the turbine blades of the turbine portion of a turbocharger powered by exhaust gas including high pressure water cleaning means for injecting water into the stream of exhaust gas, means for sensing a decrease in performance of the turbocharger indicative of the turbine blades becoming dirty and generating a signal in response thereto and control means for initiating operation of the water cleaning means in response to the detection of the signal generated by the means for sensing.

Additionally disclosed is a method for determining when to initiate water injection for effecting cleaning of dirty turbine blades of the turbine portion of a turbocharger which compresses air for an engine which includes the steps of sensing the pressure of the gas being discharged from the turbocharger, generating a start signal when the pressure of the gas being sensed is below a predetermined level, and initiating water injection to effect cleaning in response to the detection of the start signal.

DESCRIPTION OF THE PREFERRED EMBODIMENT

The apparatus and method as set forth herein will be described relative to use in cleaning the turbine blades of a specific type turbocharger. It is to be understood that this invention has like applicability to similar systems wherein a measure of performance of a portion of a system may be utilized to determine when to initiate a cleaning operation. It is further to be understood that although in the specific example shown wherein the discharge pressure from the compressor portion of the turbocharger is utilized to determine when to initiate cleaning, that any of a numerous set of operating parameters could be measured to determine performance of the turbocharger to use that value for determining when to initiate a cleaning operation.

Figure 1:
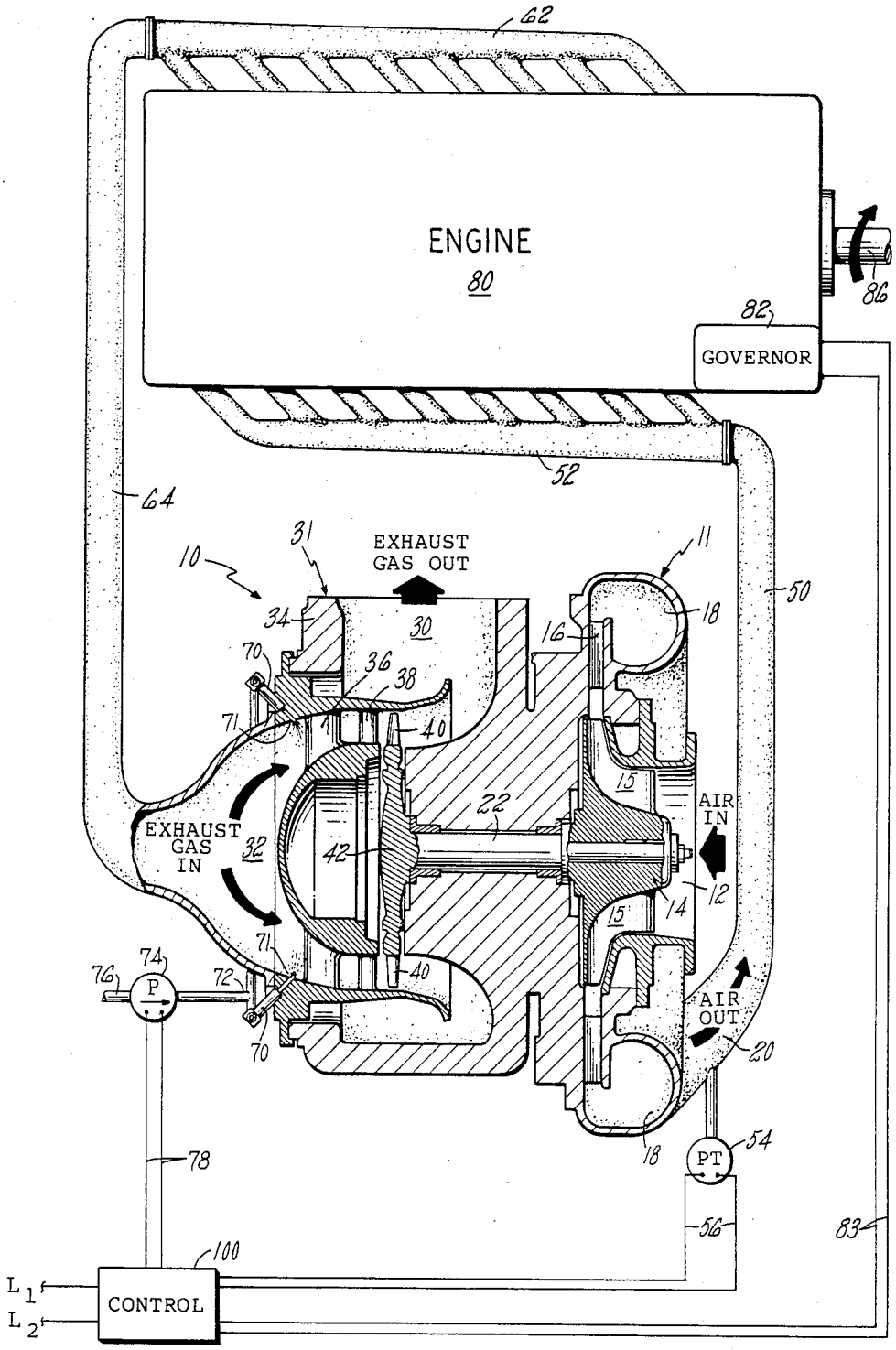
FIG. 1 is a partially sectional, partially schematic view of a turbocharger with a water wash injection system, an engine connected to the turbocharger and selected electrical connections.

Referring first to FIG. 1 there may be seen a complex diagram which includes a sectional view of a turbocharger and a schematic view of the turbocharger incorporated in a closed system with an internal combustion engine. Additionally selected electrical connections are disclosed.

As can be seen in FIG. 1 a turbocharger 10 includes a turbine section 31 and a compressor section 11. Compressor section 11 includes impeller blade 15 mounted as a portion of impeller 14 for drawing air to be compressed into the impeller through air intake 12. An arrow is shown labeled "AIR IN" indicating that air flows through air intake 12 into impeller 14. Impeller blades 15 act to accelerate the air and discharge it outwardly through diffuser 16 wherein the velocity pressure of the air is converted to static pressure to provide compressed air. Compressed air is received in collector 18 and is discharged therefrom where labeled "AIR OUT" through air discharge line 20 to air discharge conduit 50. Impeller 14 is mounted to shaft 22 which is driven by turbine section 31.

Within turbine section 31 is shown exhaust gas inlet 32 including an arrow labeled "EXHAUST GAS IN" showing that the exhaust gas from the engine enters through the inlet. The exhaust gas passes over vane 36, stator 38 and into engagement with blades 40. Blades 40 are mounted on turbine disk 42 which is secured to common shaft 22. Hot gas flows through the inlet and is directed by the vanes and the stators to engage the blades of the turbine disk to cause the shaft to rotate and to power the impeller to compress air. After the gas passes through the turbine disk it is discharged from exhaust gas discharge 30 and flows outwardly to a stack or other disposal area. An arrow labeled "EXHAUST GAS OUT" is shown to indicate the position from which the air is discharged.

Engine 80 is shown schematically as having eight cylinders. The details of the engine such as fuel supply, valve control and other integral components are not shown. Engine 80 is shown connected to supply header 52 which is connected to air discharge conduit 50 such that compressed air from the turbocharger may be supplied through the supply header or intake header to supply air to the cylinders of the engine. Exhaust header 62 is shown extending from engine 80 and being connected by exhaust conduit 64 to the exhaust gas inlet of the turbocharger. It is through this arrangement that the hot exhaust gases from the cylinders of the engine are directed to the turbine portion of the turbocharger to power the turbocharger. Shaft 86 is shown extending from the engine for delivering rotating power to an end use. Governor 82 is shown connected to the engine for controlling engine speed.

Control 100 is mounted at the bottom left-hand corner of the drawing and is connected via wires 83 to the governor 82, via wires 56 to pressure transducer 54 and via wires 78 to pump 74. Pressure transducer 54 is connected to sense the pressure of the air being discharged through air discharge 20. It is a drop in this pressure that is used to determine when the fouling of the blades has reached the point where it is significant enough that water injection should be utilized to effect cleaning of the blades.

Water injectors 70 are shown extending through the exhaust casing 34 of the turbocharger for injecting water directly into the exhaust gas stream upstream from the vanes and stators of the turbocharger. Water injector nozzle 71 is shown at the end of the water injector for providing the appropriate stream of droplets to effect cleaning as desired. Pump 74 is shown for supplying high pressure water from water supply 76 to water conduit 72 which directs the water to spaced injectors about the turbocharger. The number of injectors used is a design choice for a particular circumstance. Power is supplied to control 100 through lines L1 and L2. The control through wires 78 acts to energize the motor driving pump 74 for supplying water when desired. Control 100 is also connected by wires 83 to governor 82 for effecting speed control of the engine.

Figure 2:
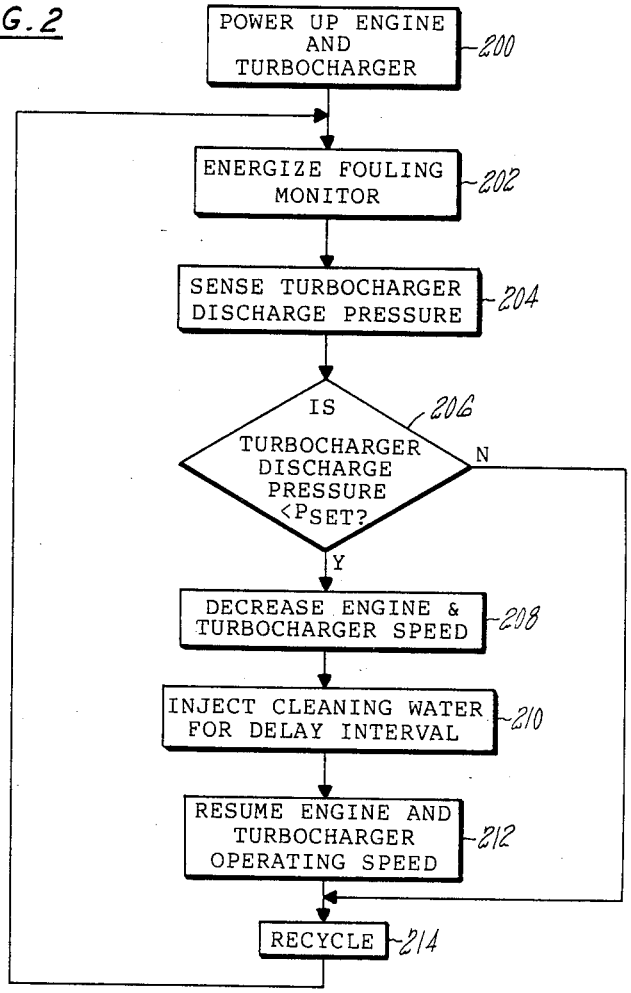
FIG. 2 is a flow chart outlining the logic used to control the cleaning of the turbine blades.

Referring more specifically to FIG. 2 there may be seen a logic flow chart of the manner in which the control for initiating operation of the cleaning means is provided. At step 200 it is indicated that the engine and turbocharger are powered up. From there the logic flows to step 202 to energize a fouling monitor to place the control in a mode for determining whether or not the blades are being fouled. From step 202 the logic flows to step 204 to sense turbocharger discharge pressure. This pressure is sensed as shown (in FIG. 1) by pressure transducer 54 in FIG. 1. When the blades of the turbine portion of the turbocharger become dirty the efficiency of the turbocharger decreases thereby decreasing the speed at which the impeller is driven. As the speed of the impeller decreases the pressure of the air being compressed by the compressor portion of the turbocharger decreases. It is this decrease in air pressure that is sensed by pressure transducer 54 to indicate that the blades are fouled.

From logic step 204 the logic flows to step 206 where the question of whether or not the turbocharger discharge pressure is less than the pressure set point is asked. If the answer is no, logic flows to step 214 indicating that cleaning is not necessary. If the answer is yes, indicating that cleaning is necessary, the logic then flows to step 208. Step 208 acts to decrease both the engine and turbocharger speed although allowing both to continue operating. Following step 210 once the turbocharger speed has been reduced to a desired level the water injection system is operated to inject water under high pressure in droplet form into the exhaust gas stream to effect cleaning of the blades. The step of injecting water continues for a preselected time interval.

From step 210 the logic flows to step 212 wherein the engine and turbocharger operating speeds are accelerated to the normal operating speed after the cleaning operation has been completed. From step 212 the logic flows to step 214 to be recycled back to step 202 to begin the logic flow path all over again.

The engine may be controlled by a governor such as a Woodward Governor manufactured by Woodward Governor Company, Engine & Turbine Controls Division of Fort Collins, Colo. Such a governor has multiple speed settings and acts to vary the speed between those settings on a gradual basis in a ramp-like manner. Hence in response to logic step 208 where it was indicated to decrease the engine and turbocharger speed, the governor would act to decrease the speed from the normal operating speed to the cleaning speed, which might be 20% of the normal operating speed, on a ramp-type basis such that the speed is gradually decreased. The reverse would happen at step 212 wherein the engine speed and turbocharger speed are both increased to the normal operating speed.

Figure 3:
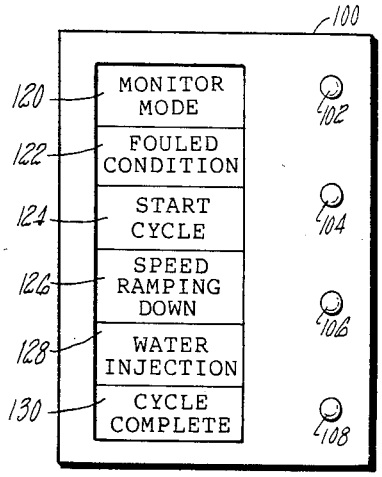
FIG. 3 is a front view of a control used with the turbocharger.

FIG. 3 discloses a front view of control panel 100 for operating a turbocharger and engine to allow same to be effectively cleaned. In FIG. 3 it may be seen that push buttons 102, 104, 106 and 108 are provided. Push button 102 is provided to initiate monitoring operation to determine whether or nor fouling is occurring. Push button 104 is provided to reset the entire sequence to place the engine and turbocharger at the normal operating speed. Push button 106 is provided to allow for manual activation of the water injection step for cleaning the blades. Push button 108 is provided as an override for discontinuing water cleaning injection and operating the turbocharger at normal operating speeds.

Indicator light 120 is provided to indicate that the unit is in the monitor mode, light 122 indicates that the blades are in the fouled condition, light 124 indicates that the engine is in a start cycle upon operation being initiated, light 126 indicates that the speed is ramping down just prior to a water injection cycle, light 128 indicates the unit is in a water injection cycle and light 130 indicates that the water injection cycle has been completed. These indicator lights are provided to advise the machine operator the mode in which the machine is operating such that he may in response to that mode of operation override the automatic cycle utilizing the buttons provided.

The specific control provided as disclosed in FIG. 1 and FIG. 3 is an electromechanical control wherein control 100 as shown in FIG. 3 receives inputs from the four push buttons and from the pressure transducer 54. The control additionally has outputs which would act to light any of the five indicators shown as well as acting to switch the position on the governor controlling the engine speed and to control operation of the motor for injecting water into the turbocharger. Of course the system need not be electromechanical but could be a solid state preprogrammed microprocessor or could be entirely manual. The degree of automation of the control is up to the designer and the perceived needs of a particular application.

The invention has been described with reference to a particular embodiment thereof. It is to be understood by those skilled in the art that variations and modifications can be effected within the spirit and scope of the invention.

What is claimed is:

1. Apparatus for controlling the cleaning of turbine blades of the turbine portion of a turbocharger powered by exhaust gas which comprises:

high pressure water cleaning means for injecting water into the stream of exhaust gas;

means for sensing a decrease in performance of the turbocharger indicative of the turbine blades becoming dirty and generating a signal in response thereto; and control means for initiating operation of the water cleaning means in response to the detection of the signal generated by the means for sensing.

2. The apparatus as set forth in claim 1 wherein the turbocharger discharges compressed air and wherein the means for sensing includes detecting the pressure of the air being discharged and generating a signal when that pressure is less than a preselected pressure level.

3. The apparatus as set forth in claim 1 and further comprising:

speed reducing means for effecting a reduction in the rotational speed of the turbine portion of the turbocharger prior to initiating operation of the water cleaning means.

4. The apparatus as set forth in claim 3 wherein the high pressure cleaning means includes a pump powered by an electric motor for supplying water to water injectors located within the stream of exhaust gas and wherein the control means is connected to the electric motor to initiate operation of the motor to effect water injection for cleaning.

5. The apparatus as set forth in claim 4 wherein the control means further comprises an indicator for revealing when the signal generated by the means for sensing is detected.

6. A method of determining when to initiate water injection for effecting cleaning of dirty turbine blades of the turbine portion of a turbocharger which compresses air for an engine which comprises the steps of:

sensing the pressure of the air being discharged from the turbocharger;

generating a start signal when the pressure of the air being sensed is below a predetermined level; and initiating water injection to effect cleaning in response to the detection of the start signal.

7. The method as set forth in claim 6 and further comprising the step of decreasing the speed of the turbocharger prior to initiating water injection.

8. The method as set forth in claim 7 wherein the step of decreasing the speed includes gradually decreasing the speed as a ramp function from normal operation speed to the desired speed for cleaning.

9. The method as set forth in claim 8 and further comprising the step of:

continuing the step of initiating water injection for a preselected time period to effect cleaning of the turbine blades.

10. The method as set forth in claim 9 wherein the turbocharger includes water injection nozzles supplied with water from a high pressure pump driven by an electric motor and wherein the step of initiating water injection includes supplying power to operate the pump motor.

11. The method as set forth in claim 6 and further comprising the step of visually indicating the presence of the start signal.

* * * * *